United States Patent [19]

Lewi

[11] 3,948,393

[45] Apr. 6, 1976

[54] DISPLAY PACKAGE

[75] Inventor: William Lewi, Merrick, N.Y.

[73] Assignee: Solo Products Corporation, Englewood, N.J.

[22] Filed: Jan. 30, 1974

[21] Appl. No.: 437,967

[52] U.S. Cl. ..... 206/462; 206/463; 206/464; 206/467

[51] Int. Cl.[2] ..... B65D 73/00

[58] Field of Search ..... 206/45, 34, 462, 463, 461, 206/464–465, 467, 470

[56] References Cited

UNITED STATES PATENTS

| | | | |
|---|---|---|---|
| 2,884,127 | 4/1959 | Neary | 206/462 |
| 2,892,541 | 6/1959 | Hahn | 206/470 |
| 3,127,993 | 4/1964 | Phipps | 206/462 X |
| 3,666,087 | 5/1972 | Cooper | 206/45.34 |
| 3,721,339 | 3/1973 | Seyer | 206/463 X |

*Primary Examiner*—William Price
*Assistant Examiner*—Steven E. Lipman
*Attorney, Agent, or Firm*—Howard C. Miskin

[57] ABSTRACT

A bubble type display package includes a cardboard base panel having a thermoplastic coated clear face and an opening, a receptacle member open at its rear and having a peripheral wall projecting through the base opening and terminating in peripherally spaced outwardly projecting ears heat sealed to the base panel rear face, and a thermoplastic cover member having peripherally spaced ears interdigitating the receptacle member ears and heat sealed to the base panel rear face. The cover member is flat or cup shaped and the cover and receptacle members are transparent.

9 Claims, 5 Drawing Figures

DISPLAY PACKAGE

BACKGROUND OF THE INVENTION

The present relates generally to improvements in receptacles and packages and it relates more particularly to an improved article dispensery and display package of the bubble or blister type.

A device commonly employed in the marketing of prepackaged articles is the bubble or blister type receptacle in which an article or group of articles are dispensed and displayed. The unit package includes a base panel and a thermoformed transparent thermoplastic bubble or blister of the desired shape, which may approximate the size and shape of the article being dispensed and displayed and which is fastened or secured to the base panel. The blister or bubble type packaging heretofore available and proposed possesses numerous drawbacks and disadvantages. It is often difficult and expensive to produce and apply to the marketed article or articles, it frequently provides only limited visual access to the packaged articles and hence limits the range of display thereof, it is difficult to open when desired to obtain access to the packaged article, it is of little versatility and adaptability and otherwise leaves much to be desired.

SUMMARY OF THE INVENTION

It is a principal object of the present invention to provide an improved receptacle.

Another object of the present invention is to provide an improved receptacle for the prepackaging and display of unit articles or groups of articles.

Still another object of the present invention is to provide an improved package of the blister or bubble type, which is easy to fabricate and low in cost.

A further object of the present invention is to provide an improved bubble or blister type of package which provides complete visual access to the packaged article from all sides thereof and is easy to open when desired to provide physical access to the packaged article.

Still a further object of the present invention is to provide a receptacle of the above nature characterized by its low cost, ease of assembly, great ruggedness and reliability, attractive appearance and high versatility and adaptability.

The above and other objects of the present invention will become apparent from a reading of the following description taken in conjunction with the accompanying drawing, which illustrates preformed embodiments thereof.

In a sense the present invention contemplates the provision of a package device comprising a base panel having a first opening therein, a receptacle member formed of a synthetic organic thermoplastic polymeric resin and having a second opening registering with said first opening and a peripheral wall bordering the second opening and projecting forwardly through the first opening, the peripheral wall having an integrally formed outwardly directed flange bonded to the rear face of the base panel, and a cover member overlying the second opening and secured to the base panel.

In the preferred form of the improved package the receptacle member is of transparent material and the flange has peripherally spaced recesses which delineate peripherally spaced ears. The cover member is likewise formed of transparent material and is provided with peripherally spaced ears which interdigitate the receptacle member ears. The rear face of the base panel is coated with a thermoplastic resin compatible with that of the receptacle and cover members and the interdigitating ears which are coplaner are heat sealed to the base panel rear face. In one form the cover member is flat and in another form it is cup shaped with a peripheral wall terminating in the outwardly directed peripherally spaced ears interdigitating the receptacle member ears.

The improved package device is easily continuously produced and applied by simple equipment, is reliable and rugged, of highly attractive appearance and of great versatility and adaptability.

DESCRIPTION OF THE PREFERRED EMBODIMENTS

Figure 1:
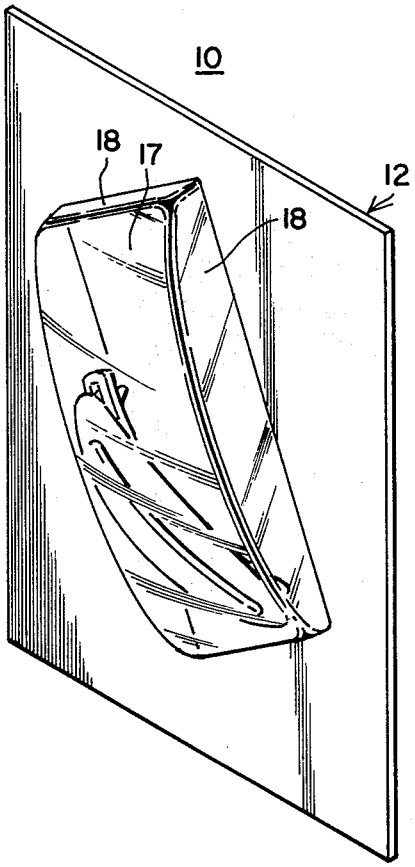
FIG. 1 is a front perspective view of a closed package embodying the present invention.

Referring now to the drawing which illustrates a preferred embodiment of the present invention, the reference numeral 10 generally designates the improved package device which houses and displays an article 11. The package device 10 includes a base panel 12, a receptacle member 13 and a cover member 14 formed and related as will be hereafter set forth.

The base panel 12, although illustrated as being of rectangular configuration may be of any desired shape and is advantageously formed of cardboard and is coated at least in its rear face with a thermoplastic polymeric resin layer 16 which is compatible and sealable with the material forming the receptacle and cover members 13 and 14 and is advantageously of a resin similar to that of the receptacle and cover members. The front face of base panel 12 may likewise be plastic resin coated and the panel front and rear faces may be colored and decorated as desired and may carry any desired illustrations and legends such as price, article identification, instructions and the like. Formed in the base panel 12 in any desired orientation is an opening corresponding in shape and dimensions to the outer periphery of the cover member 13, proximate the base thereof, which in the illustrated embodiment is rectangular.

The receptacle member 13 is formed of a transparent synthetic organic thermoplastic polymeric resin sheet suitable for thermoformery to the desired shape and for use in bubble or blister packaging, for example sheet formed of such polymeric materials as acetates, butyrates, vinyls and oriented polystyrenes. Receptacle member 13 is shaped to suitably accommodate the article 11 and includes, as shown, a forwardly convex curved cylindrical front wall 17 and rearwardly directed side and end peripheral walls 18. The peripheral walls 18 project rearwardly through the correspondingly shaped opening in base panel 12, substantially engaging the edges thereof, and terminate in coplanar outwardly directed flanges which are interrupted along their lengths by recesses which delineate peripherally regularly spaced rectangular ears 19. The ears 19, as well as the flange arms 15, engage the rear face of base panel 11 and are bonded thereto by fusing the ears 19 to the resin coating 16 at their interfaces by heating or otherwise in any known manner. The cover member 14 is a flat rectangular sheet formed of the same material as that of the receptacle member 13 and registers with the rear opening in receptacle member 13. Integrally formed along the peripheral edge of the cover member 14 are peripherally spaced ears 20 which interdigitate the ears 19. Like the ears 19, the ears 20 are bonded to the rear face of the base panel 11 concurrently with and in the same manner as ears 19. The ears 19 and 20 form a substantially continuous planar flange to enclose the article 11 in the housing defined by the receptacle and cover members 13 and 14.

The use and application of the improved package device 10 is clear from the above description. Bubble packaging equipment of generally known construction can be easily adjusted and modified to continuously shape, cut and assemble the members 12, 13, and 14 to form the package devices 10 with the articles 11 enclosed therein.

Figure 2:
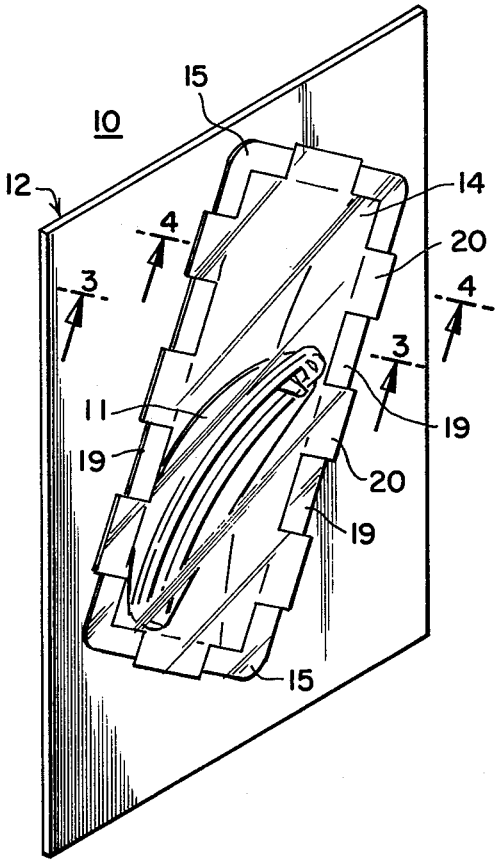
FIG. 2 is a rear perspective view thereof.
Figure 3:
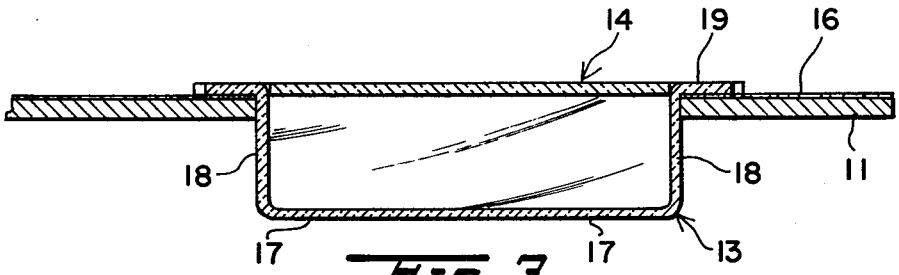
FIG. 3 is sectional view taken along line 3—3 in FIG. 2.
Figure 4:
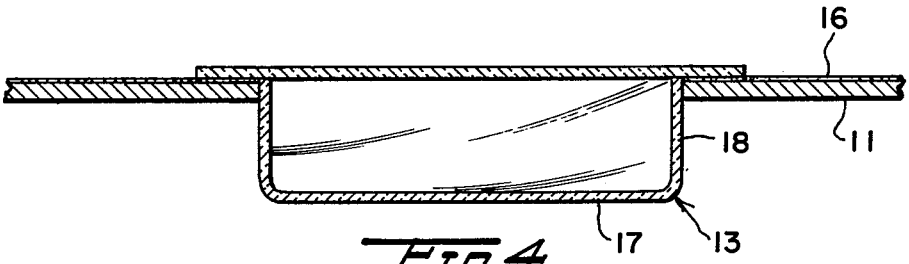
FIG. 4 is a sectional view taken along line 4—4 in FIG. 2.
Figure 5:
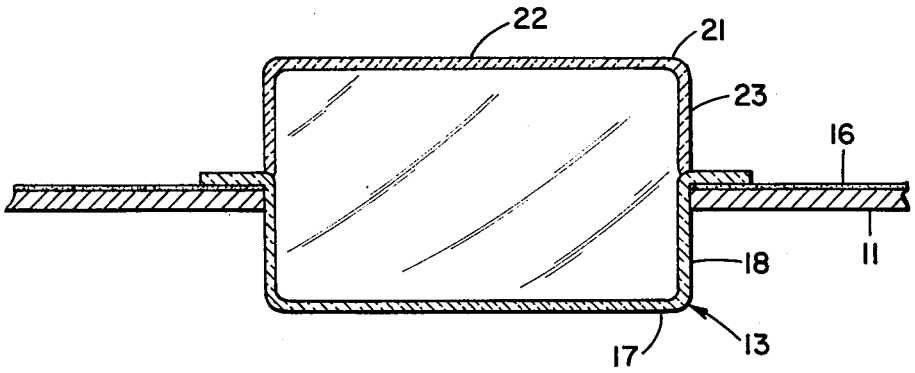
FIG. 5 is a sectional view similar to FIG. 4, but showing a further embodiment, illustrating a cover on both sides of the panel.

In a modified form of the improved device as illustrated in FIG. 5, the cover member 14 is replaced by a cover member 21 which is identical to a receptacle member 13, somewhat modified from that shown in FIG. 2. Specifically, the cover member 21 is in the shape of a shell including a rectangular rear wall 22 and forwardly directed peripheral walls 23 terminating in an outwardly directed peripheral flange which defines a rectangular frame having opposite side and end walls. Peripherally spaced recesses are formed in the flange and delineate peripherally spaced ears of the same peripheral dimensions as the recesses. The recesses and ears along each side edge flange are symmetrical with the ears and recesses respectively of the opposite side edge flange and the recesses and ears of the end edge flanges are symmetrical to the ears and recesses respectively of the opposite end edge flange so that when a cover member 21 is brought into back to back positioning with a similarly shaped receptacle member 13 with the flanges coplanar, the ears of each member coincide with the flange recesses of the other member so that the ears of the identically shaped receptacle and cover members interdigitate. The ears are fused to the rear face of the base panel 11, as in the case of the ears 19 and 20. In all other respects and in use and application the modified package device is similar to the package device earlier described.

In preparing cover members 21 and 17, they are nested and ears punched or cut out simultaneously in a manner described above such that when member 21 is rotated 180° to the position shown in FIG. 5, the ears and recesses of each member 21 and 17 interdigitate as shown.

While there have been described and illustrated preferred embodiments of the present invention it is apparent that numerous alterations, omissions and additions may be made without departing from the spirit thereof.

What is claimed is:

1. A package device comprising a base panel having a first opening therein, a receptacle member formed of a synthetic organic polymeric resin and having a second opening registering with said first opening and a peripheral wall bordering said second opening and projecting forwardly through said first opening said peripheral wall having an integrally formed outwardly directed peripheral flange bonded to the rear face of said base panel and having peripherally spaced recesses formed therein delineating peripherally spaced first ears lying in a common plane and a cover member overlying said second opening and secured to said base panel and having peripherally spaced recesses formed in the border thereof delineating peripherally spaced second ears coplanar with and interdigitating said first ears.

2. The package device of claim 1 wherein said cover member is formed of a synthetic organic thermoplastic polymeric resin and is bonded to said base panel rear face.

3. The package device of claim 2 wherein the rear face of said base panel has a thermoplastic coating bordering said first opening and said receptacle member flange and said cover member are heat sealed to said coating.

4. The package device of claim 3 wherein at least one of said receptacle and cover members is transparent.

5. The package device of claim 3 wherein said cover member is substantially flat and coplanar with said flange.

6. The package device of claim 3 wherein said receptacle member is thermoformed.

7. The package device of claim 3 wherein said cover member includes a rear wall and forwardly projecting peripheral wall terminating in said second ears.

8. The package device of claim 7 wherein said cover and receptacle members are of identical configuration.

9. The package device of claim 8 wherein the recesses and ears in each of said flanges are symmetrical to the ears and recesses respectively in the flange portions along the opposite sides and ends of the respective cover and receptacle member.

* * * * *